US011946687B1

(12) United States Patent
Fan

(10) Patent No.: US 11,946,687 B1
(45) Date of Patent: Apr. 2, 2024

(54) SHAFT MOVABLE CONTAINER

(71) Applicant: Ruochen Fan, Ningbo (CN)

(72) Inventor: Ruochen Fan, Ningbo (CN)

( * ) Notice: Subject to any disclaimer, the term of this patent is extended or adjusted under 35 U.S.C. 154(b) by 0 days.

(21) Appl. No.: 18/470,204

(22) Filed: Sep. 19, 2023

(30) Foreign Application Priority Data

Mar. 8, 2023 (CN) ..... 202320490420.7

(51) Int. Cl.
*F25D 23/02* (2006.01)
*A47B 77/16* (2006.01)
*A47G 23/08* (2006.01)

(52) U.S. Cl.
CPC ..... *F25D 23/028* (2013.01); *A47B 77/16* (2013.01); *A47G 23/08* (2013.01)

(58) Field of Classification Search
CPC ..... F25D 25/027; F25D 2325/021; A47B 49/004; A47B 96/025; A47B 49/006
See application file for complete search history.

(56) References Cited

U.S. PATENT DOCUMENTS 535,886 A * 3/1895 Brand ..... F04D 25/08 5/96
1,941,906 A * 1/1934 Marinsky ..... F25D 25/027 16/24
2,316,408 A * 4/1943 Dawson ..... F16H 25/14 74/55
2,540,125 A * 2/1951 Kolks ..... F16H 25/14 74/567
2,647,812 A * 8/1953 Saunders ..... F25D 25/027 312/294
2,840,438 A * 6/1958 Sharpe ..... F25D 25/027 211/144
2,936,205 A * 5/1960 Clark ..... F25D 25/027 D15/89
3,107,959 A * 10/1963 Maxwell, Jr. ..... F25D 25/02 312/322
4,124,262 A * 11/1978 Schill ..... A47B 49/004 312/307

(Continued)

FOREIGN PATENT DOCUMENTS

CN 113873920 A * 12/2021 ..... A47B 49/004
DE 102018108977 A1 * 10/2019 ..... A47B 49/004

(Continued)

*Primary Examiner* — Hanh V Tran

(57) ABSTRACT

A shaft movable container is provided and includes a base and a substance-placing plate movably arranged on the base. The base includes a seat body and at least three guiding rolling elements. The seat body has a top guiding surface defining a translation guiding groove extending horizontally, a plurality of top retaining members are arranged on the top guiding surface and are disposed around the translation guiding groove. Each top retaining member defines a retaining groove. Each guiding rolling element is received and rollable in the retaining groove. The substance-placing plate includes a plate board and a rotation shaft. The plate board is disposed above the seat body, the rotation shaft is rotatably and slidably mated with the translation guiding groove. The plate board has a bottom guiding surface defining a plurality of curved grooves, and each curved groove receives and fits with a guiding rolling element.

6 Claims, 13 Drawing Sheets

(56) References Cited

U.S. PATENT DOCUMENTS 4,191,437 A * 3/1980 Funke ..... A47B 49/00 D15/89
4,392,628 A * 7/1983 Hadfield ..... A47B 49/004 211/144
4,582,372 A * 4/1986 Cooper ..... A47B 81/002 312/307
6,322,679 B1 * 11/2001 De Bosscher ..... H01J 37/3455 204/192.12
6,585,119 B2 * 7/2003 Palder ..... A47F 5/02 211/49.1
7,147,445 B2 * 12/2006 Krayer ..... F16N 13/20 108/103
9,022,495 B1 * 5/2015 Conner, Sr. ..... A47F 3/08 312/238
2002/0117943 A1 * 8/2002 Gerkey ..... A47B 96/025 312/238
2005/0196310 A1 * 9/2005 Krayer ..... A47B 11/00 418/61.3
2020/0018349 A1 * 1/2020 Rehage ..... A47B 77/10
2020/0170408 A1 * 6/2020 Rehage ..... A47B 49/004
2020/0187641 A1 * 6/2020 Rehage ..... F25D 25/027
2020/0191471 A1 * 6/2020 Rehage ..... F25D 25/027
2021/0164726 A1 * 6/2021 Rehage ..... F25D 25/027
2021/0227974 A1 * 7/2021 Rehage ..... A47B 91/06
2022/0211176 A1 * 7/2022 Rehage ..... A47B 49/006
2023/0091155 A1 * 3/2023 Rehage ..... A47B 49/004 211/153

FOREIGN PATENT DOCUMENTS

DE 102019109866 A1 * 10/2020 ..... A47B 17/065
KR 20210151958 A * 12/2021
WO WO-2021001395 A1 * 1/2021
WO WO-2022157295 A1 * 7/2022

* cited by examiner

SHAFT MOVABLE CONTAINER

CROSS REFERENCE TO RELATED APPLICATIONS

The present application claims priority of the Chinese patent application No. 202320490420.7, filed on Mar. 8, 2023, and contents of which are incorporated herein by its entireties.

TECHNICAL FIELD

The present disclosure relates to the field of furniture, and in particular to a shaft movable container.

BACKGROUND

A storage space, such as a compartment or a storage cavity of a refrigeration, usually has a door that can be opened and closed. This type of storage space has a fixed width. When the door is opened, an opening of the storage space is less restricted. In order to loading articles into the storage space or unloading articles from the storage space more conveniently, a Chinese patent (Grant Publication No. CN 111970941 B) discloses a storage rack for furniture or household appliances. The patent specifically discloses that, in order to enable a storage tray 4 to rotate and translate with respect to a support plate 3, each of a lower surface of the storage tray 4 and an upper surface of the support plate 3 defines recesses 32 and 34 for receiving rolling elements. Further, in order to mount a guiding rolling element 6, a holder 9 is arranged. In this way, during assembly, an assembly of the holder 9 and the guiding rolling element 6 needs to be disposed between the storage tray 4 and the support plate 4. Therefore, in order to achieve correct operation, the guiding rolling element 6 needs to be aligned with the rolling element recess 32 defined in the support plate 4, and the guiding rolling element 6 needs to be aligned, when a field of view is obscured, with the rolling element recess 44 defined in the storage tray 4. In addition, the holder 9 may be loose relative to the support plate 3 or the storage tray 4 during assembly. Further, since the rolling element recesses 32 and 34 may be narrow, the storage rack may be assembled difficultly. While in use, since the upper surface of the support plate defines the rolling element recess 32, liquid and/or fine dust may be collected in the recess, and the collected liquid and/or fine dust may not be cleared easily by wiping. The collected liquid and/or fine dust may be cleared only by disassembling the entire storage rack.

SUMMARY OF THE DISCLOSURE

The present disclosure provides a shaft movable container, aiming to solve the technical problem that the container in the art may not be assembled and cleaned easily.

In order to achieve the above objective, the present disclosure provides a shaft movable container, including a base and a substance-placing plate movably arranged on the base. The substance-placing plate is rotatable about a predetermined vertical axis relative to the base and is translatable in a predetermined horizontal direction relative to the base.

The base comprises a seat body and a plurality of guiding rolling elements, the number of the plurality of guiding rolling elements is three or more; the seat body has a top guiding surface facing upwardly, the top guiding surface defines a translation guiding groove extending in the predetermined horizontal direction, a plurality of top retaining members are dispersedly arranged on the top guiding surface and are disposed at a periphery of the translation guiding groove, each of plurality of top retaining members defines a retaining groove having an opening facing upwardly, each of the plurality of guiding rolling elements is received and rollable in the retaining groove of a corresponding one of the plurality of top retaining members.

The substance-placing plate comprises a plate board and a rotation shaft protruding from a lower surface of the plate board, the plate board is disposed above the seat body, the rotation shaft is rotatably mated with the translation guiding groove around the predetermined vertical axis and is slidably mated with the translation guiding groove in the predetermined horizontal direction; the plate board has a bottom guiding surface, which is facing downwardly and is opposite to the top guiding surface, the bottom guiding surface defines a plurality of curved grooves, and each of the plurality of curved grooves receives and fits with a corresponding one of the plurality of guiding rolling elements.

In some embodiments, the bottom guiding surface is arranged with a plurality of bottom retaining members that are dispersedly distributed, each of the plurality of bottom retaining members defines a retaining groove having an opening facing downwardly; the substance-placing plate further comprises a plurality of support rolling members, each of the plurality of support rolling members is received and rollable in the retaining groove of a correspondingly one of the plurality of bottom retaining members, the plurality of support rolling members are rollably engaged with the top guiding surface.

In some embodiments, the number of the plurality of guiding rolling elements is four, two of the four guiding rolling elements are located in a length direction of the translation guiding groove, and a distance between the two guiding rolling elements is D1; the other two of the four guiding rolling elements are located in a width direction of the translation guiding groove, and a distance between the other two guiding rolling elements is D2; the D1 is greater than the D2; the plurality of bottom retaining members are disposed both within a region of the bottom guiding surface surrounded by the curved groove and out of the region of the bottom guiding surface surrounded by the curved groove.

In some embodiments, the substance-placing plate comprises a limiting member detachably connected to a lower end of the rotation shaft, the limiting member protrudes from an outer periphery surface of the rotation shaft and is disposed under an edge portion of the translation guiding groove.

In some embodiments, the rotation shaft is cylindrical and integrally formed with the plate board; a screw hole post, which is extending along a vertical axis, is arranged on and protruding from an inner peripheral surface of the rotation shaft; the limiting member is plate-shaped and defines a via hole corresponding to the screw hole post; the substance-placing plate further comprises a fastener, and the fastener passes through the via hole and is fixedly connected to a screw hole of the screw hole post.

In some embodiments, a plurality of positioning tabs are arranged at an edge region of an upper surface of the seat body, a top surface of each of plurality of positioning tabs defines a positioning recess, the positioning recess has an outwardly extending convex curved surface; a plurality of positioning posts are arranged at an edge region of the lower surface of the plate board, an outer peripheral surface of each of the plurality of positioning posts is a convex curved surface; when the shaft movable container is at an initial loaded position, the plurality of positioning posts and the plurality of positioning tabs are in one-to-one correspondence, each of the plurality of positioning posts is received in the positioning recess of the corresponding one of the plurality of positioning tabs.

In some embodiments, a plurality of reinforcing ribs are arranged both within a region of the lower surface of the plate board enclosed by the curved groove and out of the region of the lower surface of the plate board enclosed by the curved groove.

In some embodiments, the rotation shaft is detachably connected to the plate board, an outer peripheral surface of the rotation shaft comprises a tapered surface tapering from an upper end to a lower end; an inner wall surface of the translation guiding groove comprises two inclined surfaces opposite to each other in a width direction of the translation guiding groove, a distance between the two inclined surfaces gradually increased from an upper portion to a lower portion of the translation guiding groove.

The tapered surface of the rotation shaft is rotatably mated with the inclined surfaces of the translation guiding groove around the predetermined vertical axis and is slidably mated with the inclined surfaces of the translation guiding groove in the predetermined horizontal direction; the tapered surface of the rotation shaft is limitedly mated with the inclined surfaces of the translation guiding groove in an up-down direction.

In some embodiments, a mounting post is arranged on and protruding from the lower surface of the plate board, a lower surface of the mounting post defines a fixation hole; a lower end of the mounting post extends into the translation guiding groove, the mounting post is rotatably mated with the translation guiding groove around the predetermined vertical axis and is slidably mated with the translation guiding groove along the predetermined horizontal direction.

An upper surface of the rotation shaft is attached to the lower surface of the mounting post, the rotation shaft defines a through hole corresponding to the fixation hole, the substance-placing plate further comprises a fastener, and the fastener passes through the through hole and is fixedly connected to the fixation hole.

In some embodiments, the base further comprises a plurality of first magnetic members disposed at an edge region of an upper surface of the seat body; the substance-placing plate further comprises a plurality of second magnetic members disposed at an edge region of the lower surface of the plate board; when the shaft movable container is in an initial loaded position, the plurality of first magnetic members and the plurality of second magnetic members are in one-to-one correspondence and are magnetically absorbed with each other for positioning.

For the container provided in the present disclosure, the top retaining member is arranged on the seat body of the base, and the guiding rolling element is received in the retaining groove of the top retaining member, such that, during assembly, the user only needs to focus on aligning the seat body with the plate board. In this way, the assembly efficiency is improved. In combination, only the bottom guiding surface of the plate board needs to define the curved groove. Therefore, the upper surface of the seat body, such as the top guiding surface, may be a relatively flat surface, such that liquid and/or dust on the upper surface of the seat body may be cleared more easily.

BRIEF DESCRIPTION OF THE DRAWINGS

In order to more clearly illustrate technical solutions in the embodiments of the present disclosure, the accompanying drawings for describing the embodiments will be briefly introduced in the following. Apparently, the accompanying drawings in the following show only some of the embodiments of the present disclosure, and other accompanying drawings may be obtained based on these drawings by any ordinary skilled person in the art without creative work.

DETAILED DESCRIPTION

Figure 1:
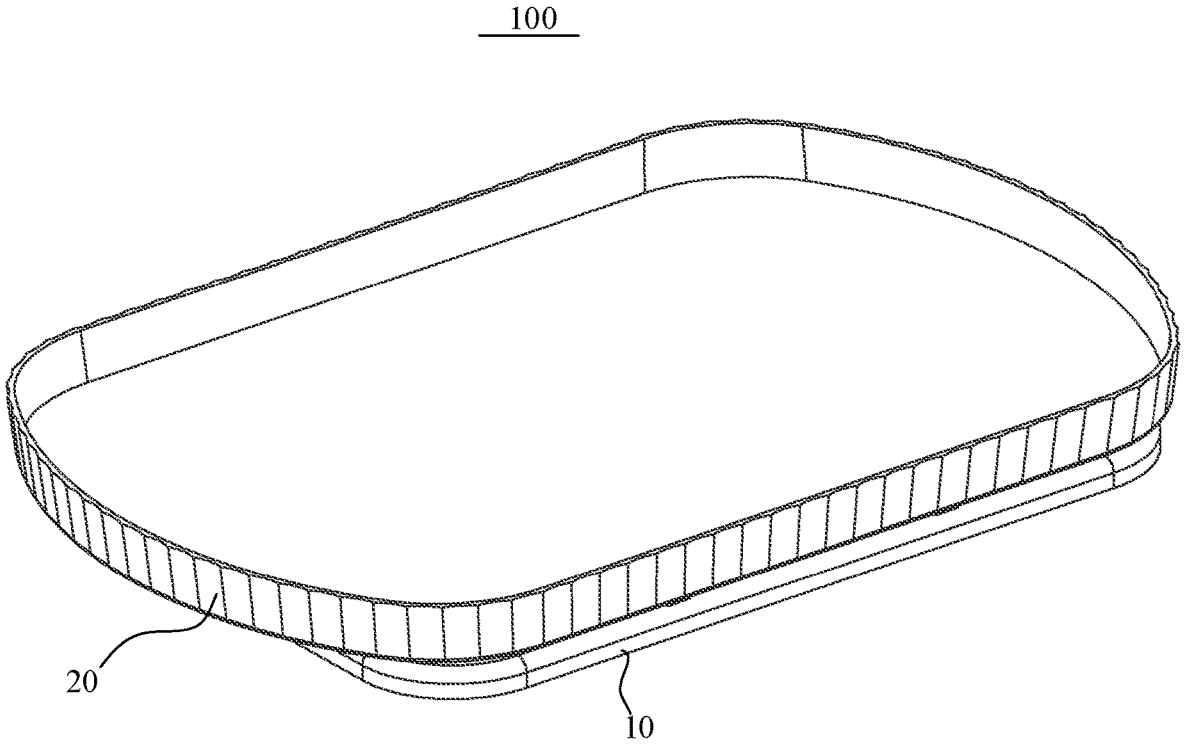
FIG. 1 is a perspective view of a shaft movable container according to a first embodiment of the present disclosure.
Figure 2:
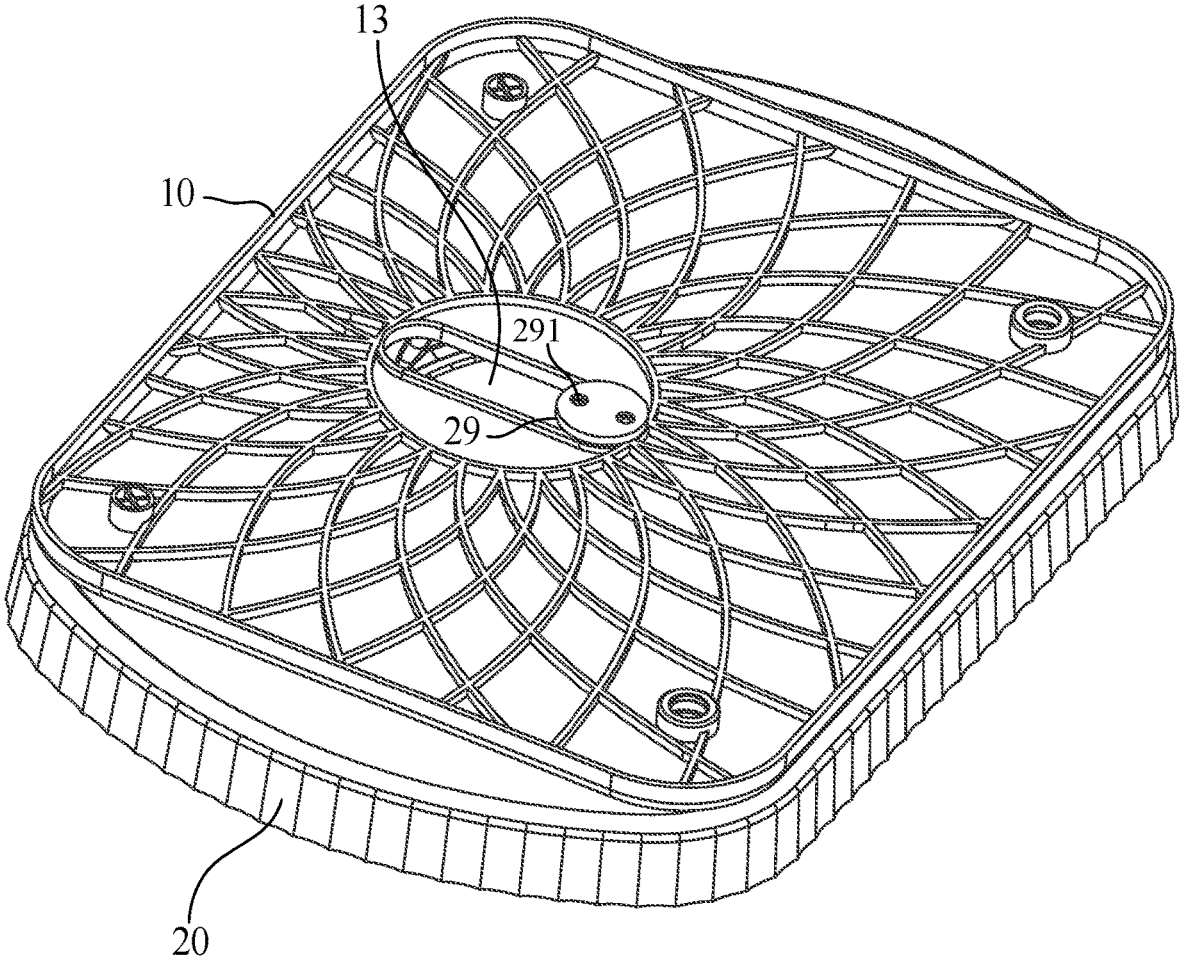
FIG. 2 is a perspective view of the shaft movable container shown in FIG. 1, being viewed from a bottom.
Figure 3:
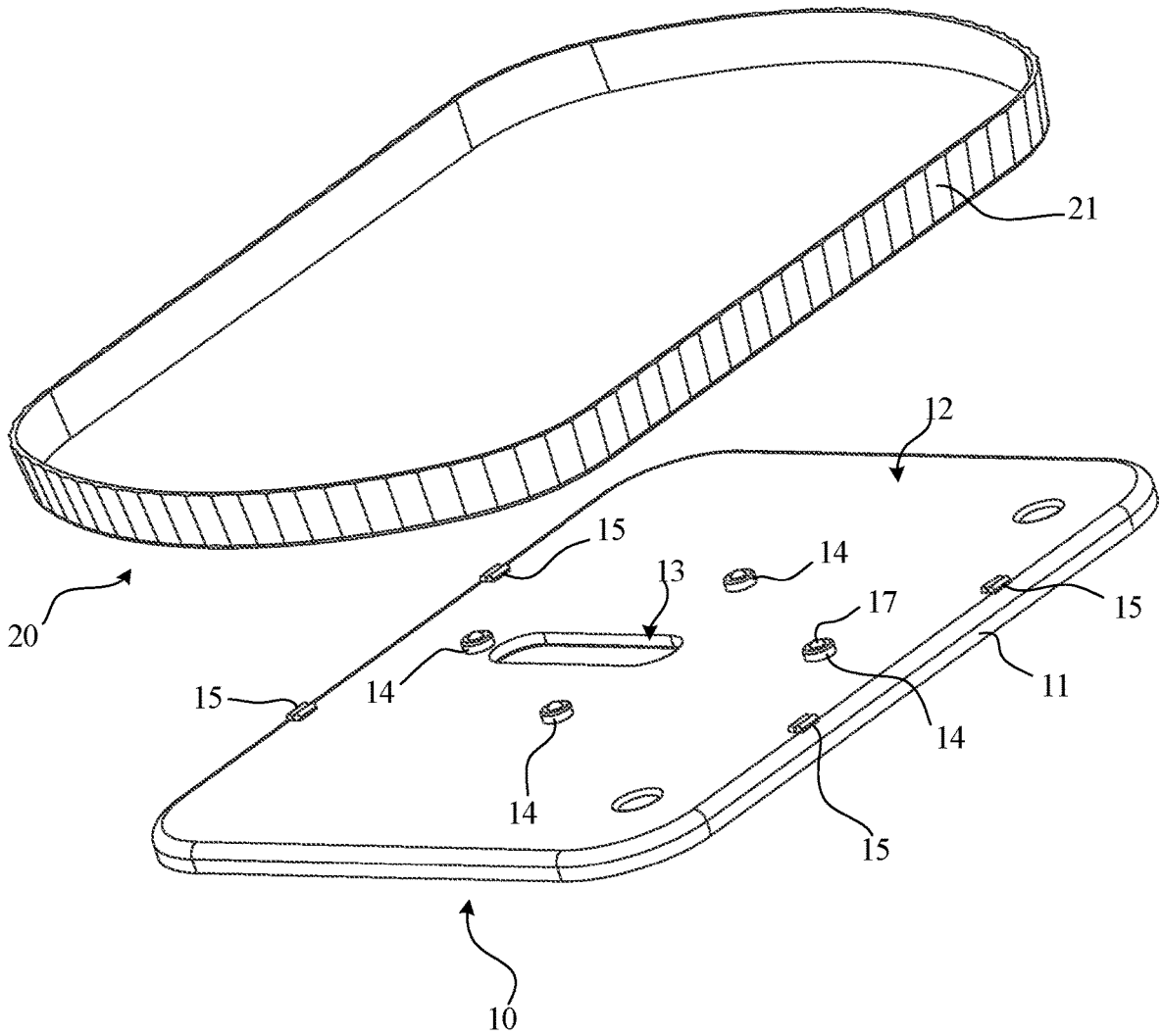
FIG. 3 is an exploded view of the shaft movable container shown in FIG. 1, being viewed from a top.
Figure 4:
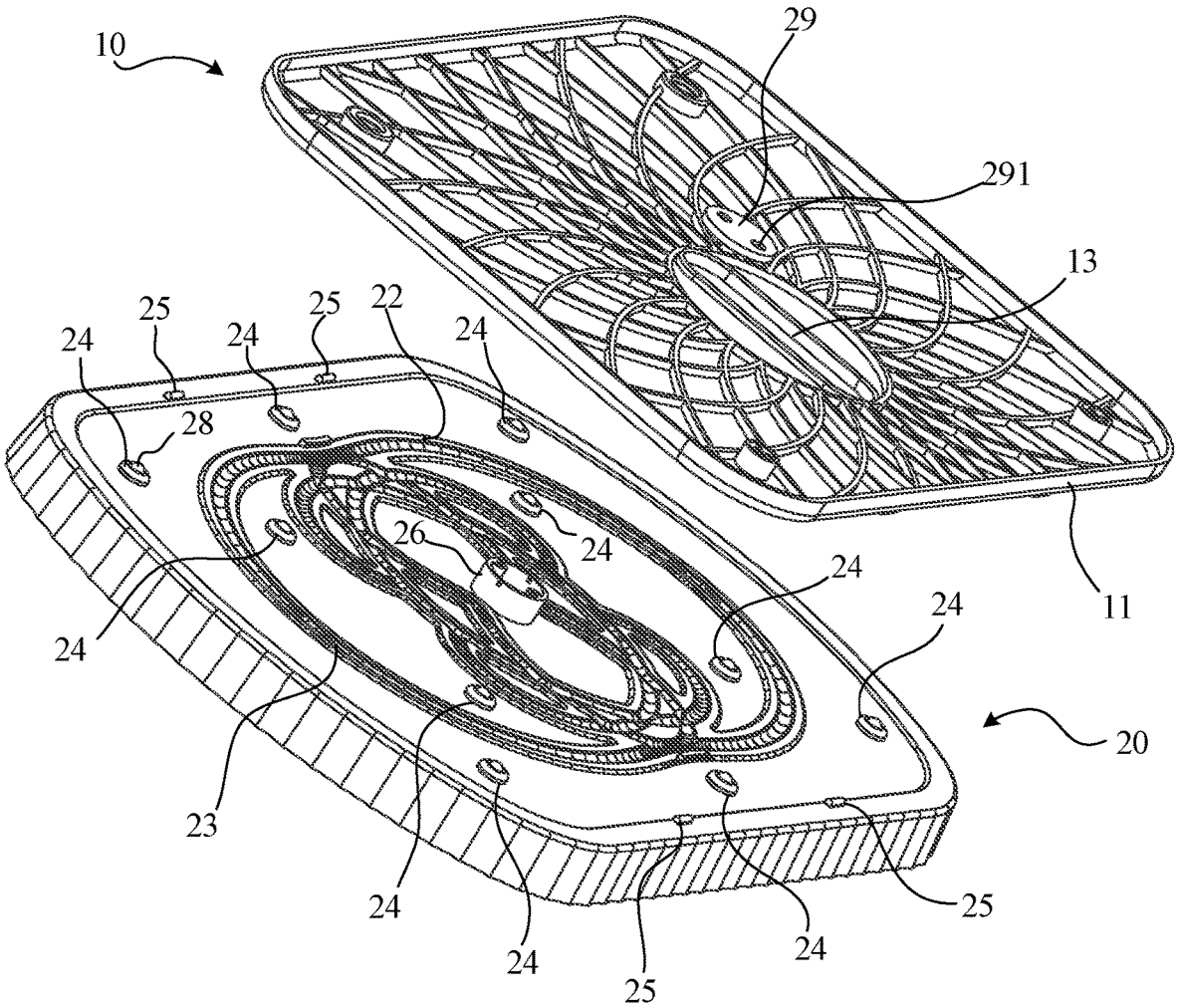
FIG. 4 is an exploded view of the shaft movable container shown in FIG. 1, being viewed from the bottom.
Figure 5:
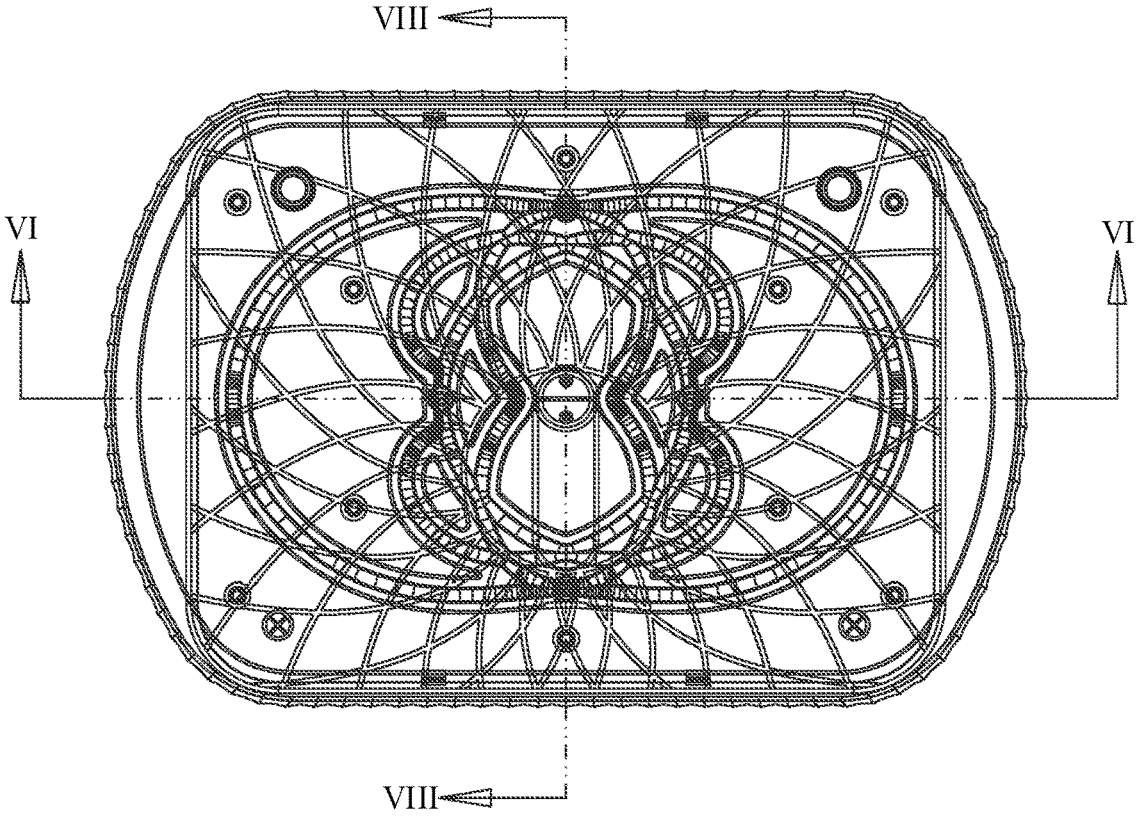
FIG. 5 is a cross-sectional perspective view of the shaft movable container shown in FIG. 1, being viewed from the top.
Figure 6:
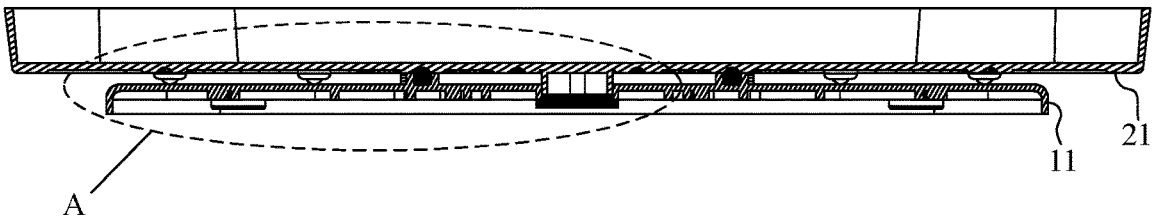
FIG. 6 is a cross-sectional view of the shaft movable container shown in FIG. 5, taken along the line VI-VI.
Figure 7:
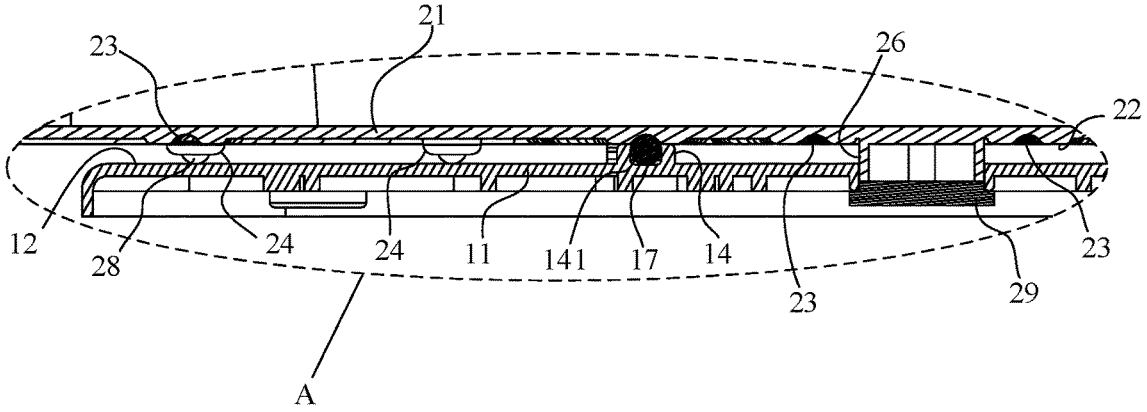
FIG. 7 is an enlarged view of the portion A of the shaft movable container shown in FIG. 6.

Technical solutions in the embodiments of the present disclosure will be described clearly and completely in the following by referring to the accompanying drawings in the embodiments of the present disclosure. Apparently, the described embodiments show only a part of but not all of the embodiments of the present disclosure. Based on the embodiments in the present disclosure, all other embodiments, which are obtained by any ordinary skilled person in the art without creative work, shall fall within the scope of the present disclosure.

As shown in FIG. 1 to FIG. 7 and FIG. 12 to FIG. 15, in the first and the second embodiments of the present disclosure, a shaft movable container 100, 200 is provided. The shaft movable container 100, 200 includes a base 10, 30 and a substance-placing plate 20, 40 movably arranged on the base 10, 30. The substance-placing plate 20, 40 is rotatable about a predetermined vertical axis relative to the base 10, 30 and is translatable in a predetermined horizontal direction relative to the base 10, 30. The shaft movable container 100, 200 further includes following.

The base 10, 30 includes a seat body 11, 31 and at least three guiding rolling elements 17, 35. The seat body 11, 31 has a top guiding surface 12, 32 facing upwardly. The top guiding surface 12, 32 defines a translation guiding groove 13, 33 extending in the predetermined horizontal direction. A plurality of top retaining members 14, 34 are dispersedly arranged on the top guiding surface 12, 32 and are disposed at a periphery of the translation guiding groove 13, 33. Each of plurality of top retaining members 14, 34 defines a retaining groove 141 having an opening facing upwardly. A plurality of guiding rolling elements 17, 35 are arranged. Each of plurality of guiding rolling elements 17, 35 is received and rollable in the retaining groove 141 of a corresponding one of the plurality of top retaining members 14, 34.

The substance-placing plate 20, 40 includes a plate board 21, 41 and a rotation shaft 26, 46 protruding from a lower surface of the plate board 21, 41. The plate board 21, 41 is disposed above the seat body 11, 31. The rotation shaft 26, 46 is rotatably mated with the translation guiding groove 13, 33 around the predetermined vertical axis and is slidably mated with the translation guiding groove 13, 33 in the predetermined horizontal direction. The plate board 21, 41 has a bottom guiding surface 22, 42, which is facing downwardly and is opposite to the top guiding surface 12, 32. The bottom guiding surface 22, 42 defines a plurality of curved grooves 23, 43. Each of the plurality of curved grooves 23, 43 receives and fits with a corresponding one of the plurality of guiding rolling elements 17, 35.

In the present embodiment, in order to reduce space occupation, the seat body 11, 31 may be flat. The seat body 11, 31 of the base 10, 30 may be simply placed on a support surface of a furniture and may be stationary with respect to the support surface by static friction. Alternatively, the seat body 11, 31 may be fixedly connected to the furniture by a suction, a snap, a clamp, and so on. The predetermined vertical axis may correspond to a gravitational vertical line. The predetermined horizontal direction may correspond to a front-rear direction. In some embodiments, the predetermined vertical axis may be inclined to a certain extent relative to the gravitation. The predetermined horizontal direction may be other horizontal directions, such as a left-right direction. Taking the predetermined horizontal direction being the front-rear direction as an example, since the translation guiding groove 13, 33 has a certain length, movement of the rotation shaft 26, 46 may be guided by the guiding rolling elements 17, 35 and the curved grooves 23, 43. Compared to a fixed shaft being rotating, the plate board 21, 41 of the substance-placing plate 20, 40 in the present disclosure occupies less space in the left-right direction during the rotation. In order to simplify the structure, the guiding rolling elements 17, 35 may be spherical.

Figure 12:
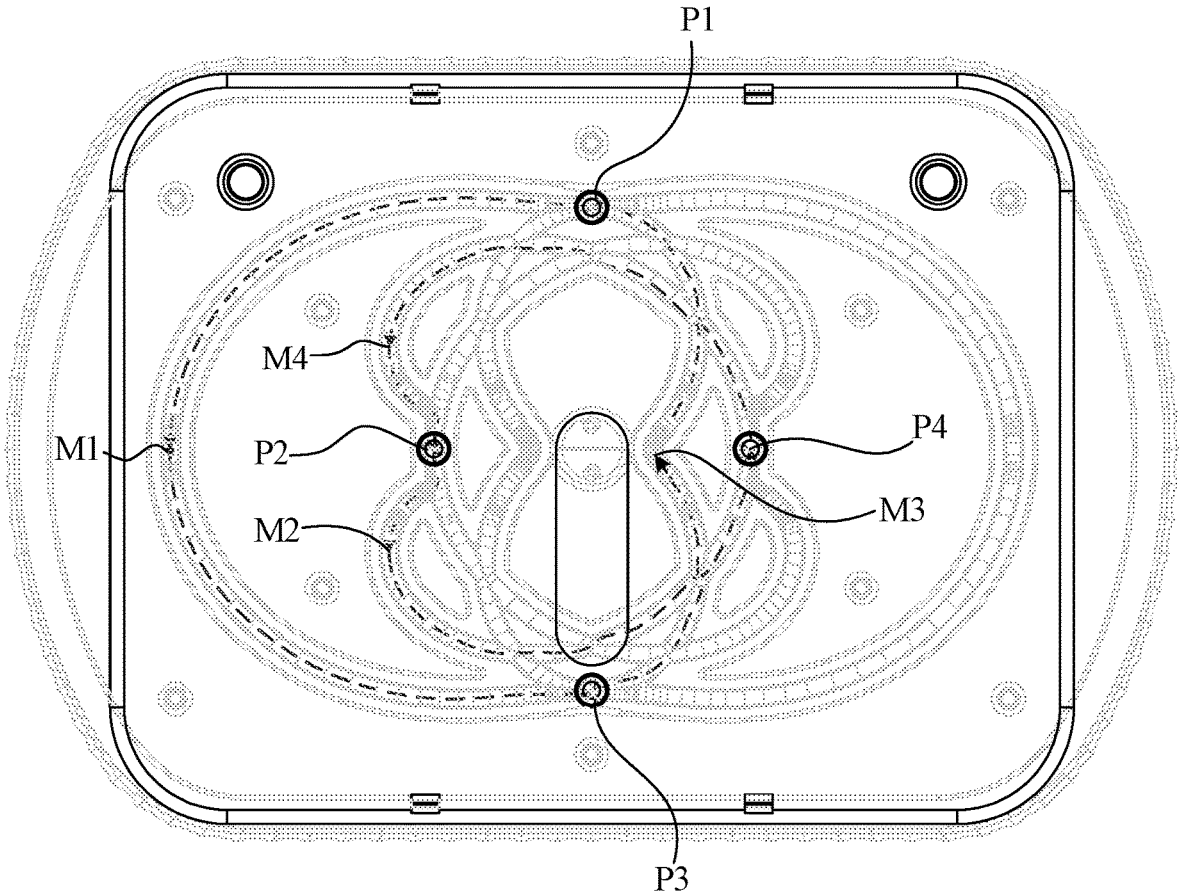
FIG. 12 shows paths of the guiding rolling element in the curved groove while the shaft movable container shown in FIG. 1 rotating 180 degrees in the anti-clockwise direction starting from the loading position, where only the substance-placing plate is shown perspectively.
Figure 13:
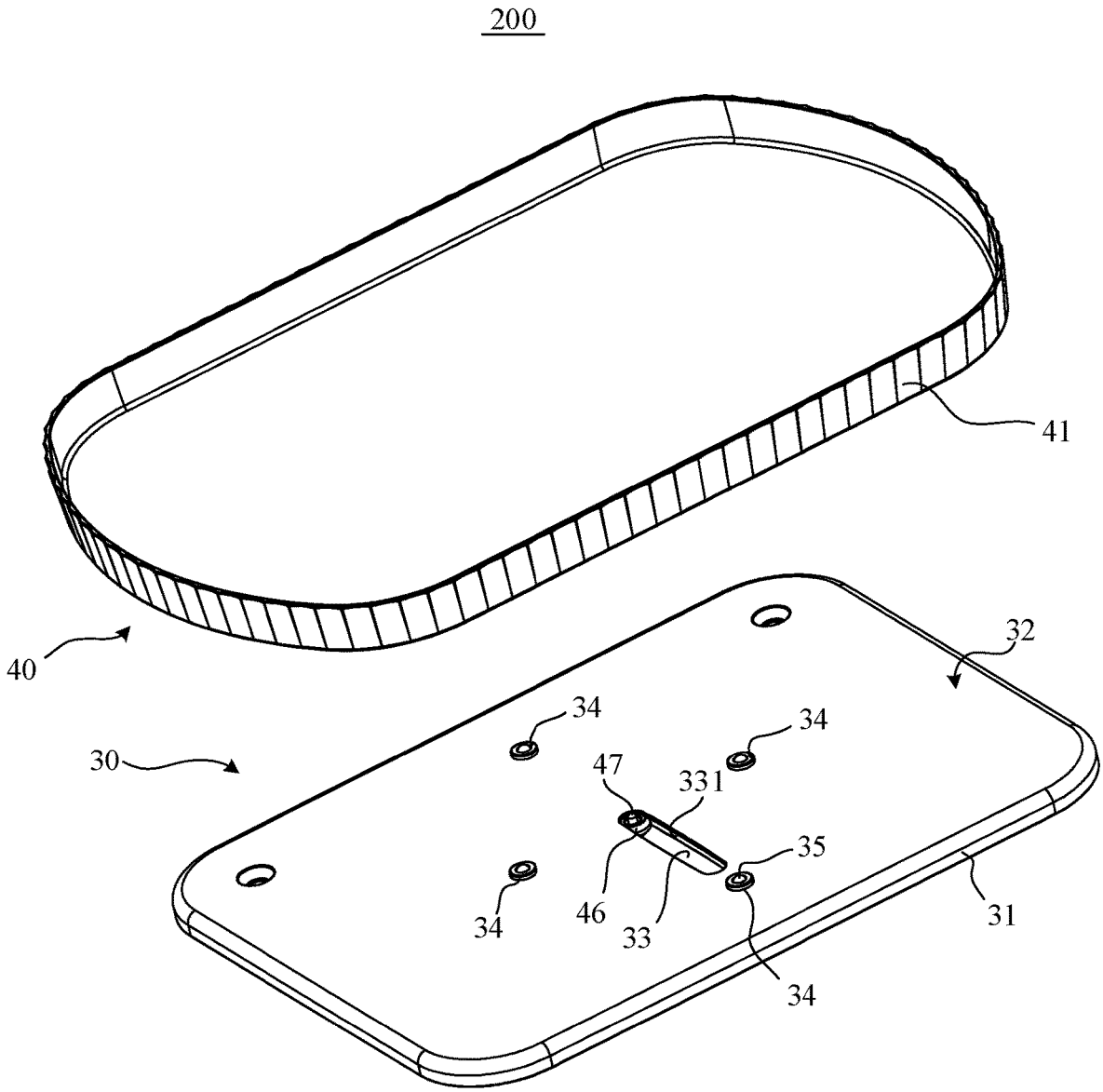
FIG. 13 is a perspective view of a shaft movable container according to a second embodiment of the present disclosure.
Figure 14:
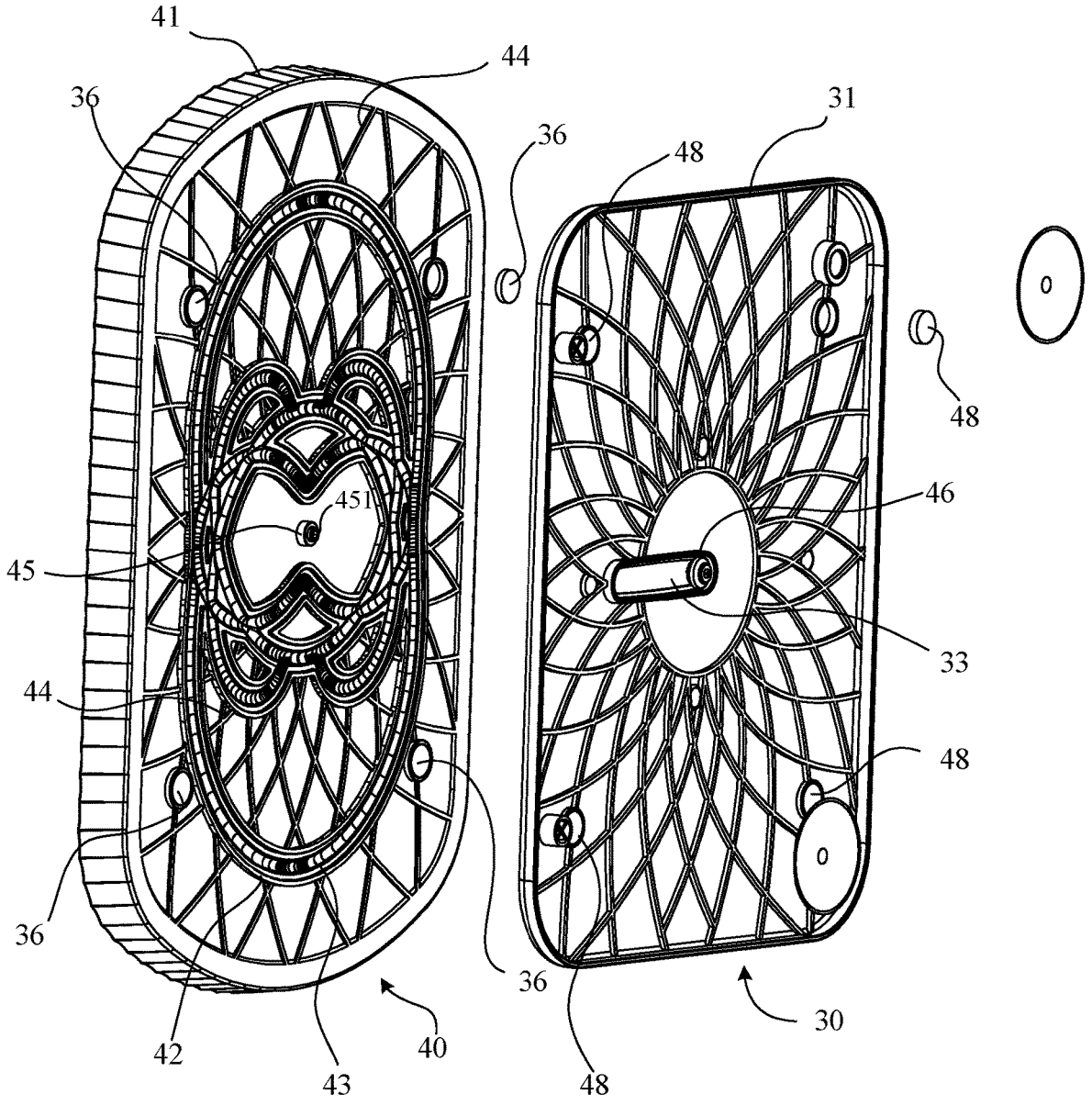
FIG. 14 is an exploded view of the shaft movable container shown in FIG. 13, being viewed from a top.
Figure 15:
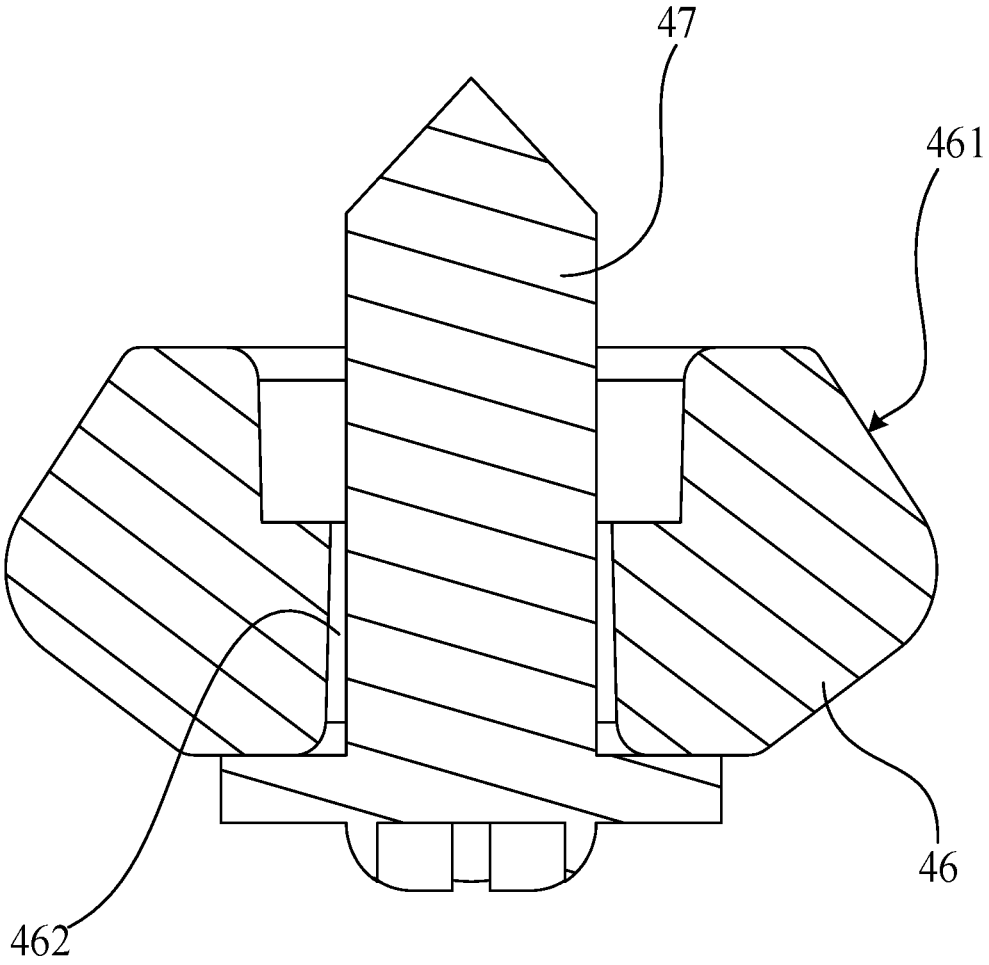
FIG. 15 is an exploded view of the shaft movable container shown in FIG. 13, being viewed from a bottom.

The plate board 21, 41 of the substance-placing plate 20, 40 may be a simple flat plate board or a container having side walls. A rotation angle for which the substance-placing plate 20, 40 may rotate may be determined based on demands, for example, the rotation angle may be 180 degrees or 360 degrees. In order to achieve anti-clockwise and clockwise rotation, the substance-placing plate 20, 40 may be configured to rotate 360 degrees. The movement of the substance-placing plate 20, 40 may be composite of rotation and translation. For example, as shown in FIG. 10, while the substance-placing plate 20, 40 is rotating 90 degrees in an anti-clockwise direction from a loaded position, the rotation shaft 26, 46 moves from the rear to the front in the translation guiding groove 13, 33 (as shown in FIG. 10A, FIG. 10B, FIG. 10C, FIG. 10D, FIG. 10E, FIG. 10F, in sequence). Correspondingly, as shown in FIG. 12, a travelling path of one of the plurality of guiding rolling elements 17, 35 disposed at a front position in the curved groove 23, 43 is from P1 to M1. A travelling path of one of the plurality of guiding rolling elements 17, 35 disposed at a left position in the curved groove 23, 43 is from P2 to M2. A travelling path of one of the plurality of guiding rolling elements 17, 35 disposed at a rear position in the curved groove 23, 43 is from P3 to M3. A travelling path of one of the plurality of guiding rolling elements 17, 35 disposed at a right position in the curved groove 23, 43 is from P4 to M4. As shown in FIG. 10, the substance-placing plate 20, 40 is rotating for another 90 degrees after rotating for 90 degrees from the loaded position, and in this case, the rotation shaft 26, 46 moves from the front to the rear in the translational guiding groove 13, 33 (as shown in FIG. 11*a*, FIG. 11*b*, FIG. 11*c*, FIG. 11*d*, FIG. 11*e*, and FIG. 11*f* in sequence). Correspondingly, as shown in FIG. 12, a travelling path of one of the plurality of guiding rolling elements 17, 35 disposed at a front position in the curved groove 23, 43 is from M1 to P3. A travelling path of one of the plurality of guiding rolling elements 17, 35 disposed at a left position in the curved groove 23, 43 is from M2 to P3. A travelling path of one of the plurality of guiding rolling elements 17, 35 disposed at a rear position in the curved groove 23, 43 is from M3 to P1. A travelling path of one of the plurality of guiding rolling elements 17, 35 disposed at a right position in the curved groove 23, 43 is from M4 to P2.

For the shaft movable container 100, 200 in the present disclosure, the top retaining members 14, 34 are arranged on the seat body 11, 31 of the base 10, 30, and the guiding rolling elements 17, 35 are received in the retaining grooves 141 of the top retaining members 14, 34, respectively. Therefore, while assembling the container, the user only needs to focus on aligning the seat body 11, 31 with the plate board 21, 41, such that an assembly efficiency is improved. In combination, since only the curved grooves 23, 43 are required to be defined in the bottom guiding surface 22, 42 of the plate board 21, 41, the upper surface of the seat body 11, 31, such as the top guiding surface 12, 32, may be a relatively flat surface, such that liquid and/or dust on the upper surface of the seat body 11, 31 may be cleared easily.

As shown in FIG. 1 to FIG. 7, in the first embodiment, in practice, when the plate board 21 is deformed to a large extent due to supporting a heavy object, a spatial location in which the curved groove 23 is located may be deformed, resulting in the guiding rolling element 17 being unable to roll smoothly. Further, in order to ensure the substance-placing plate 20 to rotate smoothly even when carrying heavy objects, the bottom guiding surface 22 is further arranged with a plurality of bottom retaining members 24 that are dispersedly distributed. Each of the plurality of bottom retaining members 24 defines a retaining groove 241 having an opening facing downwardly. The substance-placing plate 20 further includes a plurality of support rolling members 28. The plurality of support rolling members 28 may be received and rollable in the retaining groove 241 of a correspondingly one of the plurality of bottom retaining members 24. The plurality of support rolling members 28 is rollably engaged with the top guiding surface.

Further, in order to enable the substance-placing plate 20 to rotate more stably, the base includes four guiding rolling elements 17. Two of the four guiding rolling elements 17 are located in a length direction of the translation guiding groove 13, and a distance between the two guiding rolling elements 17 is D1. The other two of the four guiding rolling elements 17 are located in a width direction of the translation guiding groove 13, and a distance between the other two guiding rolling elements 17 is D2. The D1 is greater than the D2. The plurality of bottom retaining members 24 are disposed both within a region of the bottom guiding surface 22 surrounded by the curved groove 23 and out of the region of the bottom guiding surface 22 surrounded by the curved groove 23.

Further, in order to prevent the plate board 21 from accidentally being loose and fallen and to enable the plate board 21 to be detachable, the substance-placing plate 20 further includes a limiting member 29 detachably connected to a lower end of the rotation shaft 26. The limiting member 29 protrudes from an outer periphery of the rotation shaft 26 and is disposed under an edge portion of the translation guiding groove 13. Specifically, the rotation shaft 26 is cylindrical and integrally formed with the plate board 21. A screw hole post 27, which is extending along a vertical axis, is arranged on and protruding from an inner peripheral surface of the rotation shaft 26. The limiting member 29 is plate-shaped and defines a via hole 291 corresponding to the screw hole post 27. The substance-placing plate 20 further includes a fastener (not shown in the drawings), the fastener passes through the via hole 291 and is fixedly connected to a screw hole of the screw hole post 27. In this way, the plate board 21 is fixed and is also detachable, and in addition, the number of components is reduced.

Figure 8:
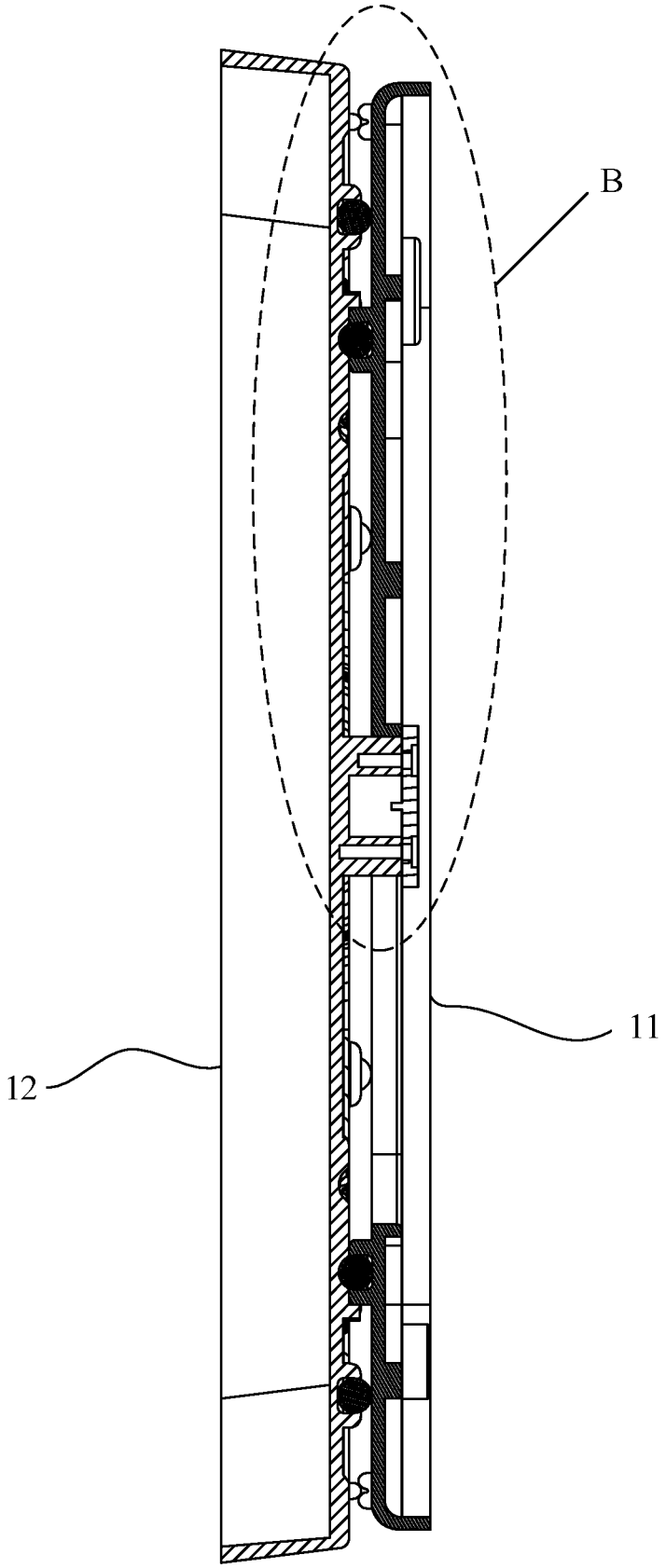
FIG. 8 is a cross-sectional view of the shaft movable container shown in FIG. 5, taken along the line VIII-VIII.
Figure 9:
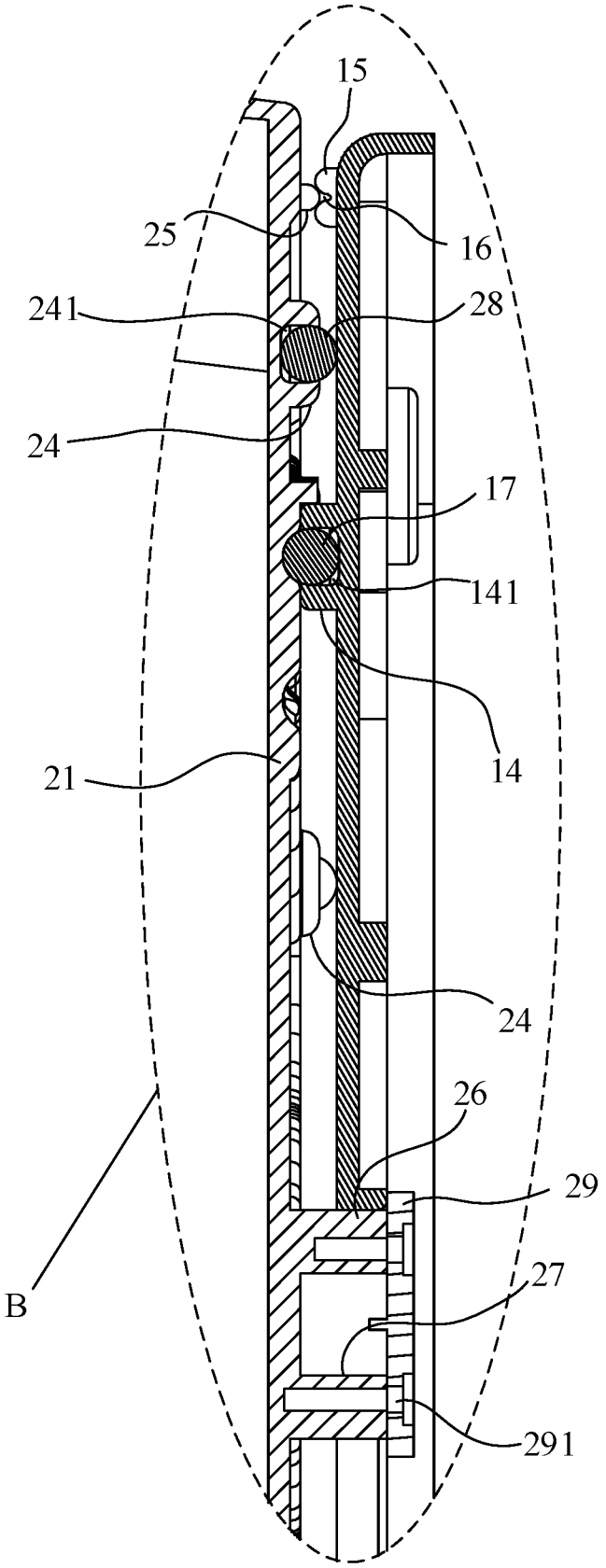
FIG. 9 is an enlarged view of the portion B of the shaft movable container shown in FIG. 8.
Figure 10A:
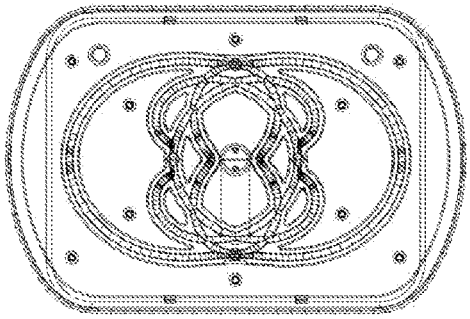
FIG. 10A shows a first state of the shaft movable container shown in FIG. 1, while the shaft movable container is rotating 90 degrees in an anti-clockwise direction starting from a loading position, where only the substance-placing plate is shown perspectively.
Figure 10D:
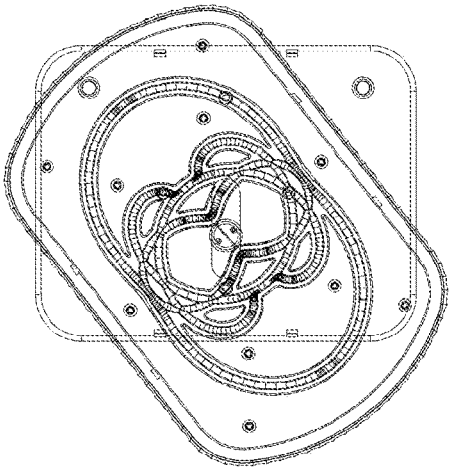
FIG. 10D shows a fourth state of the shaft movable container shown in FIG. 1, while the shaft movable container is rotating 90 degrees in the anti-clockwise direction starting from the loading position, where only the substance-placing plate is shown perspectively.
Figure 10B:
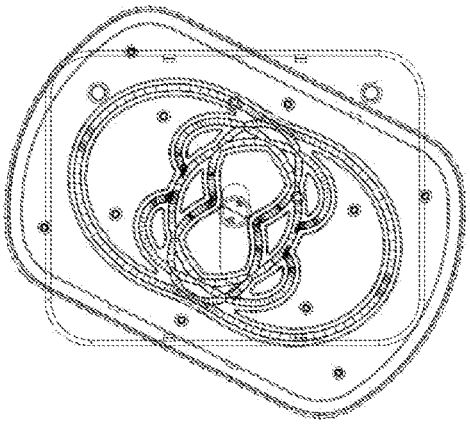
FIG. 10B shows a second state of the shaft movable container shown in FIG. 1, while the shaft movable container is rotating 90 degrees in the anti-clockwise direction starting from the loading position, where only the substance-placing plate is shown perspectively.
Figure 10E:
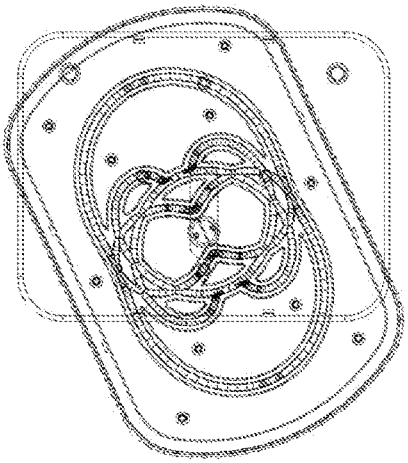
FIG. 10E shows a fifth state of the shaft movable container shown in FIG. 1, while the shaft movable container is rotating 90 degrees in the anti-clockwise direction starting from the loading position, where only the substance-placing plate is shown perspectively.
Figure 10C:
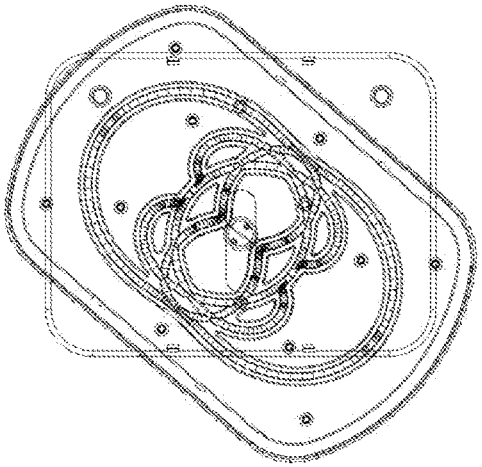
FIG. 10C shows a third state of the shaft movable container shown in FIG. 1, while the shaft movable container is rotating 90 degrees in the anti-clockwise direction starting from the loading position, where only the substance-placing plate is shown perspectively.
Figure 10F:
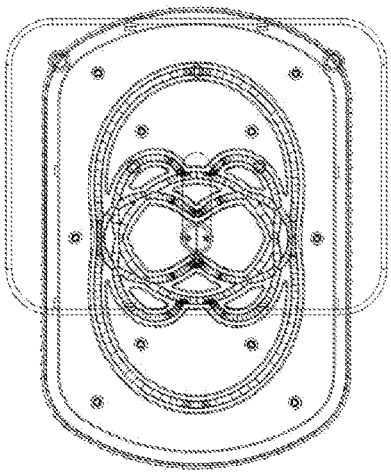
FIG. 10F shows a sixth state of the shaft movable container shown in FIG. 1, while the shaft movable container is rotating 90 degrees in the anti-clockwise direction starting from the loading position, where only the substance-placing plate is shown perspectively.
Figure 11A:
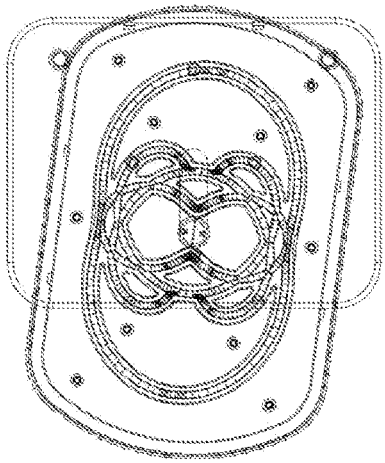
FIG. 11A is a first state of the shaft movable container shown in FIG. 1, while the shaft movable container is rotating for another 90 degrees in an anti-clockwise direction after rotating 90 degrees relative to the loading position, where only the substance-placing plate is shown perspectively.
Figure 11D:
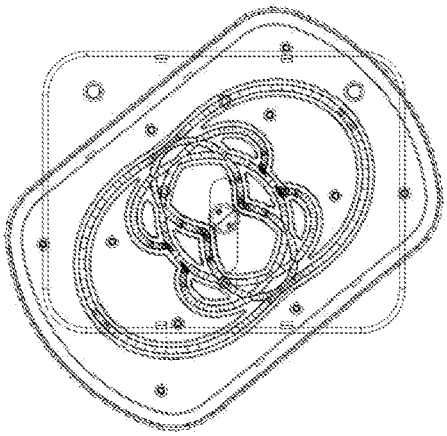
FIG. 11D is a fourth state of the shaft movable container shown in FIG. 1, while the shaft movable container is rotating for another 90 degrees in an anti-clockwise direction after rotating 90 degrees relative to the loading position, where only the substance-placing plate is shown perspectively.
Figure 11B:
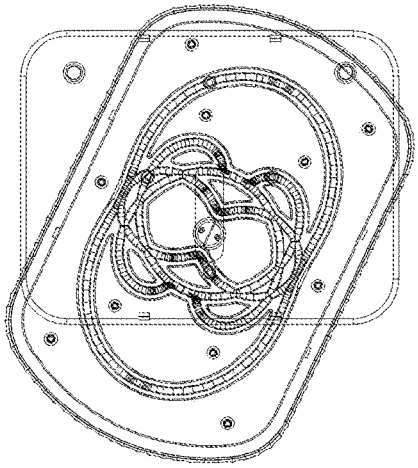
FIG. 11B is a second state of the shaft movable container shown in FIG. 1, while the shaft movable container is rotating for another 90 degrees in an anti-clockwise direction after rotating 90 degrees relative to the loading position, where only the substance-placing plate is shown perspectively.
Figure 11E:
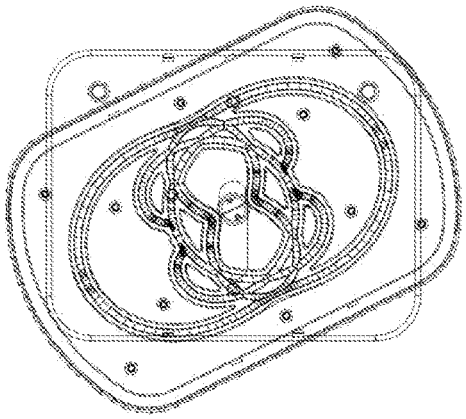
FIG. 11E is a fifth state of the shaft movable container shown in FIG. 1, while the shaft movable container is rotating for another 90 degrees in an anti-clockwise direction after rotating 90 degrees relative to the loading position, where only the substance-placing plate is shown perspectively.
Figure 11C:
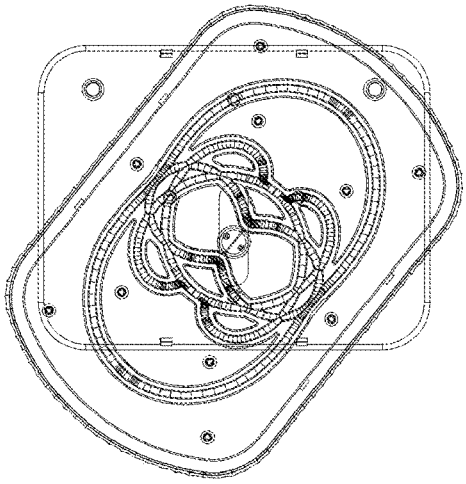
FIG. 11C is a third state of the shaft movable container shown in FIG. 1, while the shaft movable container is rotating for another 90 degrees in an anti-clockwise direction after rotating 90 degrees relative to the loading position, where only the substance-placing plate is shown perspectively.
Figure 11F:
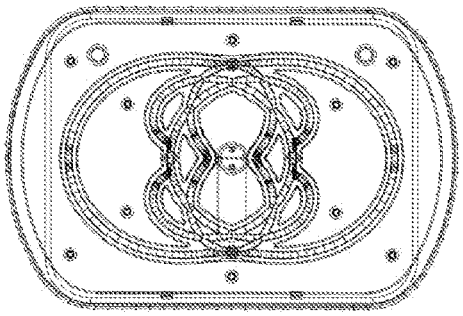
FIG. 11F is a sixth state of the shaft movable container shown in FIG. 1, while the shaft movable container is rotating for another 90 degrees in an anti-clockwise direction after rotating 90 degrees relative to the loading position, where only the substance-placing plate is shown perspectively.

Further, as shown in FIG. 8 and FIG. 9, in order to enable the user to realize more clearly that the shaft movable container has reached to the loaded position and in order to prevent the plate board 21 from accidentally rotating, a plurality of positioning tabs 15 are arranged at an edge region of the upper surface of the seat body. A top surface of each of plurality of positioning tabs 15 defines a positioning recess 16. The positioning recess 16 has an outwardly extending convex curved surface. A plurality of positioning posts 25 are arranged at an edge region of the lower surface of the plate board 21. An outer peripheral surface of each of the plurality of positioning posts 25 is a convex curved surface. When the shaft movable container is at the initial loaded position, the plurality of positioning posts 25 and the plurality of positioning tabs 15 are in one-to-one correspondence, each of the plurality of positioning posts 25 is received in the corresponding one of the plurality of positioning tabs 15.

Further, as shown in FIG. 12 to FIG. 15, in the second embodiment, in order to prevent smooth rolling of the guiding rolling elements 35 from being affected by deformation of the spatial location of the curved groove 43, a plurality of reinforcing ribs 44 are arranged both within a region of the lower surface of the plate board 41 enclosed by the curved groove 43 and out of the region of the lower surface of the plate board 41 enclosed by the curved groove 43.

Further, in order to prevent the plate board 41 from being loose and fallen accidentally and to enable the plate board 41 to be detachable, the rotation shaft 46 may be detachably connected to the plate board 41. An outer peripheral surface of the rotation shaft 46 includes a tapered surface 461 tapering from an upper end to a lower end. An inner wall surface of the translation guiding groove 33 includes two inclined surfaces 331 opposite to each other in the width direction of the translation guiding groove 33. A distance between the two inclined surfaces 331 gradually increased from an upper portion to a lower portion.

The tapered surface 461 of the rotation shaft 46 is rotatably mated with the inclined surfaces 331 of the translation guiding groove 33 around the predetermined vertical axis and is slidably mated with the inclined surfaces 331 of the translation guiding groove 33 in the predetermined horizontal direction. The tapered surface 461 of the rotation shaft 46 is limitedly mated with the inclined surfaces 331 of the translation guiding groove 33 in an up-down direction.

Further, in order to enable the substance-placing plate 40 to move more stably and to mount the rotation shaft 46 more conveniently, a mounting post 45 is arranged on and protruding from the lower surface of the plate board 41. A lower surface of the mounting post 45 defines a fixation hole 451. A lower end of the mounting post 45 extends into the translation guiding groove 33. The mounting post 45 is rotatably mated with the translation guiding groove 33 around the predetermined vertical axis and is slidably mated with the translation guiding groove 33 along the predetermined horizontal direction.

An upper surface of the rotation shaft 46 is attached to the lower surface of the mounting post 45. The rotation shaft 46 defines a through hole 462 corresponding to the fixation hole 451. The substance-placing plate 40 further includes a fastener 47, and the fastener 47 passes through the through hole 462 and is fixedly connected to the fixation hole 451.

In the present embodiment, arrangement of the mounting post 45 increases the mating surface with the translation guiding groove 33, such that the substance-placing plate 40 may move more stably.

Further, in order to enable the user to more clearly perceive that the shaft movable container 200 has reached the loaded position and to prevent the plate board 41 from accidentally rotating, the base 30 further includes a plurality of first magnetic members 36 disposed at the edge region of the upper surface of the seat body. The substance-placing plate 40 further includes a plurality of second magnetic members 48 disposed at the edge region of the lower surface of the plate board 41. When the shaft movable container 200 is in an initial loaded position, the first magnetic members 36 and the second magnetic members 48 are in one-to-one correspondence and are magnetically absorbed with each other for positioning.

Finally to be noted that the above embodiments are only used to illustrate, but not limit, the technical solutions of the present disclosure. Although the disclosure has been described in detail by referring to the foregoing embodiments, any ordinary skilled person in the art shall understand that the technical solutions in the foregoing embodiments may be modified, or some of the technical features may be replaced with equivalent ones. These modifications or replacements do not drive the essence of the corresponding technical solutions out of the spirit and the scope of the technical solutions of the various embodiments of the present disclosure.

What is claimed is:

1. A shaft movable container, comprising a base and a substance-placing plate movably arranged on the base, wherein the substance-placing plate is rotatable about a predetermined vertical axis relative to the base and is translatable in a predetermined horizontal direction relative to the base, wherein, the base comprises a seat body and a plurality of guiding rolling elements, a number of the plurality of guiding rolling elements is three or more; the seat body has a top guiding surface facing upwardly, the top guiding surface defines a translation guiding groove extending in the predetermined horizontal direction, a plurality of top retaining members are dispersedly arranged on the top guiding surface and are disposed at a periphery of the translation guiding groove, each of the plurality of top retaining members defines a retaining groove having an opening facing upwardly, each of the plurality of guiding rolling elements is received and rollable in the retaining groove of a corresponding one of the plurality of top retaining members;

the substance-placing plate comprises a plate board and a rotation shaft protruding from a lower surface of the plate board, the plate board is disposed above the seat body, the rotation shaft is rotatably mated with the translation guiding groove around the predetermined vertical axis and is slidably mated with the translation guiding groove in the predetermined horizontal direction; the plate board has a bottom guiding surface, which is facing downwardly and is opposite to the top guiding surface, the bottom guiding surface defines a plurality of curved grooves, and each of the plurality of curved grooves receives and fits with a corresponding one of the plurality of guiding rolling elements;

wherein the substance-placing plate comprises a limiting member detachably connected to a lower end of the rotation shaft, the limiting member protrudes from an outer periphery surface of the rotation shaft and is disposed under an edge portion of the translation guiding groove, wherein the rotation shaft is cylindrical and integrally formed with the plate board; a screw hole post, which is extending along a vertical axis, is arranged on and protrudes from an inner peripheral surface of the rotation shaft; the limiting member is plate-shaped and defines a via hole corresponding to the screw hole post.

2. The shaft movable container according to claim 1, wherein the bottom guiding surface is arranged with a plurality of bottom retaining members that are dispersedly distributed, each of the plurality of bottom retaining members defines a retaining groove having an opening facing downwardly; the substance-placing plate further comprises a plurality of support rolling members, each of the plurality of support rolling members is received and rollable in the retaining groove of a correspondingly one of the plurality of bottom retaining members, the plurality of support rolling members are rollably engaged with the top guiding surface.

3. The shaft movable container according to claim 2, wherein the number of the plurality of guiding rolling elements is four, two of the four guiding rolling elements are located in a length direction of the translation guiding groove, and a distance between the two guiding rolling elements is D1; other two of the four guiding rolling elements are located in a width direction of the translation guiding groove, and a distance between the other two guiding rolling elements is D2; the D1 is greater than the D2; the plurality of bottom retaining members are disposed both within a region of the bottom guiding surface surrounded by the plurality of curved grooves and out of the region of the bottom guiding surface surrounded by the plurality of curved grooves.

4. The shaft movable container according to claim 1, wherein a plurality of positioning tabs are arranged at the edge region of the upper surface of the seat body, a top surface of each of the plurality of positioning tabs defines a positioning recess, the positioning recess has an outwardly extending convex curved surface; a plurality of positioning posts are arranged at the edge region of the lower surface of the plate board, an outer peripheral surface of each of the plurality of positioning posts is a convex curved surface; when the shaft movable container is at an initial loaded position, the plurality of positioning posts and the plurality of positioning tabs are in one-to-one correspondence, each of the plurality of positioning posts is received in the positioning recess of the corresponding one of the plurality of positioning tabs.

5. The shaft movable container according to claim 1, wherein a plurality of reinforcing ribs are arranged both within a region of the lower surface of the plate board enclosed by the plurality of curved grooves and out of the region of the lower surface of the plate board enclosed by the plurality of curved grooves.

6. The shaft movable container according to claim 1, wherein the base further comprises a plurality of first magnetic members disposed at an edge region of an upper surface of the seat body; the substance-placing plate further comprises a plurality of second magnetic members disposed at an edge region of the lower surface of the plate board when the shaft movable container is in an initial loaded position, the plurality of first magnetic members and the plurality of second magnetic members are in one-to-one correspondence and magnetically attract each other for positioning.

* * * * *